United States Patent [19]

Martin et al.

[11] Patent Number: 4,669,399

[45] Date of Patent: Jun. 2, 1987

[54] METHOD OF REDUCING THE $NO_x$ CONTENT IN COMBUSTION GASES

[75] Inventors: Helmut Martin; Wolfgang Schreier, both of Gummersbach, Fed. Rep. of Germany

[73] Assignee: L. & C. Steinmüller GmbH, Gummersbach, Fed. Rep. of Germany

[21] Appl. No.: 791,761

[22] Filed: Oct. 28, 1985

[30] Foreign Application Priority Data

Nov. 15, 1984 [DE] Fed. Rep. of Germany ..... 3441675

[51] Int. Cl.[4] ..... F23D 1/00

[52] U.S. Cl. ..... 110/347; 110/265; 431/4; 431/10

[58] Field of Search ..... 431/4, 8, 10, 174, 175, 431/179; 110/243, 263, 265, 237, 238, 347

[56] References Cited

U.S. PATENT DOCUMENTS

| | | | |
|---|---|---|---|
| 411,555 | 9/1889 | Mason | 431/175 |
| 3,611,954 | 10/1971 | Monroe | 110/238 |
| 3,738,289 | 6/1973 | Hanway | 110/237 |
| 4,403,941 | 9/1983 | Okiura et al. | 431/10 |
| 4,496,306 | 1/1985 | Okigami et al. | 431/8 |

*Primary Examiner*—Carroll B. Dority, Jr.
*Attorney, Agent, or Firm*—Becker & Becker

[57] ABSTRACT

A method of reducing the $NO_x$ content in combustion gases by introducing secondary fuel, via a liquid carrier, into the combustion chamber at a location disposed between the supply of fuel and air for the primary combustion, and the supply of secondary air for the complete combustion.

2 Claims, 3 Drawing Figures

METHOD OF REDUCING THE $NO_x$ CONTENT IN COMBUSTION GASES

BACKGROUND OF THE INVENTION

1. Field of the Invention

The present invention relates to a method of reducing the $NO_x$ content in combustion gases by introducing secondary fuel, via a carrier medium, into the combustion chamber at a location disposed between the supply of fuel and air for the primary combustion, and the supply of secondary air for the complete combustion.

2. Description of the Prior Art

It is already known to reduce the $NO_x$ content of the combustion gases within the combustion chamber (furnace or boiler) by carrying out the primary combustion in a reducing atmosphere with an insufficient quantity of air, whereby a portion of the air required for complete combustion being supplied downstream of the primary combustion zone. It is furthermore known, for the purpose of reducing the $NO_x$ content, to supply secondary fuel, by means of a gaseous carrier medium, after the primary combustion zone and prior to the supply of the residual air required for the complete combustion; the flue gas of the primary combustion serves as the carrier medium.

It has become evident that the introduction of secondary fuel with a gaseous carrier, such as air or combustion gas, for reducing the $NO_x$ content, causes difficulties, particularly in large combustion chambers. With a gaseous carrier, the mixture of secondary fuel and carrier does not penetrate deep enough into the combustion chamber. The thorough mixing which is absolutely necessary is therefore achieved only after relatively long mixing times. Furthermore, the distribution and control of the supply of fuel causes difficulties: Generally, a good thorough mixing can be achieved only with a series of nozzles, with the diameter and speed of the nozzles having to be optimized. However, the arrangement and number of such nozzles is structurally very complicated and expensive. Furthermore, when individual introduction or injection locations are not operative, significant impairment of the operation results. In the extreme case, the entire unit must be shut down. In addition, when a large capacity unit is being operated, the type of secondary fuel introduction required for an optimum reduction of the $NO_x$ content has to be adjusted as a function of load conditions. This variation of the type of introduction as a function of the load in turn requires considerable structrual expense. For the aforementioned reasons, the previously described reduction of the $NO_x$ content via secondary fuel was utilized only in test installations, but not in large-scale units, i.e. on the order of magnitude of 1000 to 2000 metric tons of steam per hour.

An object of the present invention is to provide a method with which, in a straight forward manner, the $NO_x$ content in the combustion gases of large-capacity combustion units, especially steam generators, is effectively reduced.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
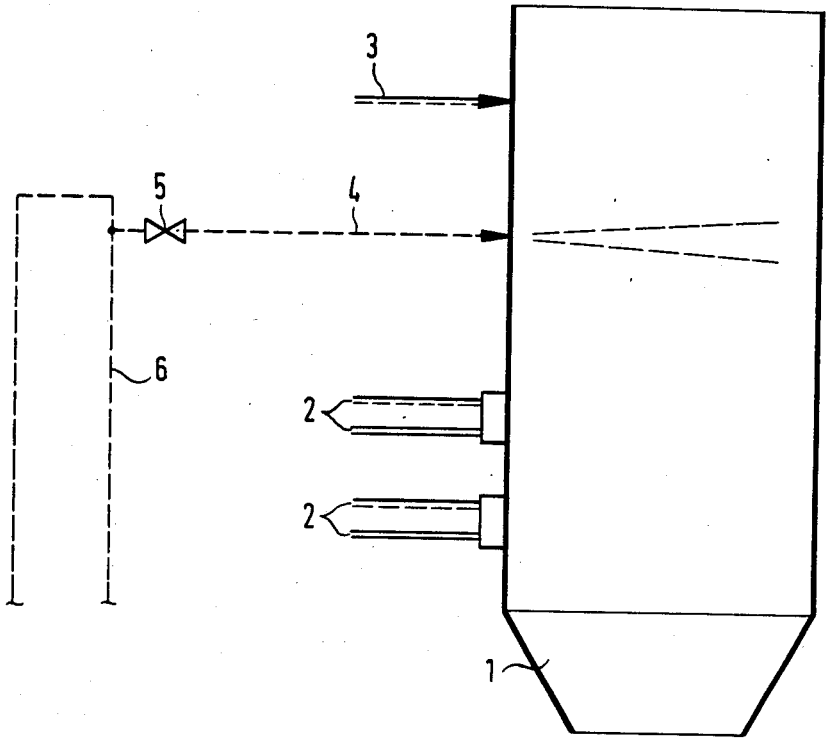
FIG. 1 is a view showing a longitudinal section through a boiler illustrating the application of the inventive method.
Figure 2:
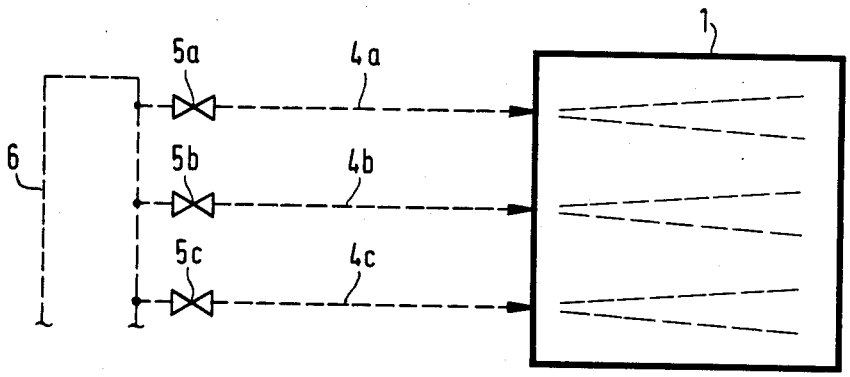
FIG. 2 is a view showing a horizontal section through the boiler of FIg. 1.

The method of the present invention is characterized primarily in that the secondary fuel is introduced into combustion chamber via a fluid or liquid carrier.

A particularly advantageous application of the inventive method is with combustion processes which are based on a dry combustion or a slag tap boiler combustion. Pursuant to the present invention, not only solid fuels, such as coal, but also liquid fuels, such as oil, are suitable as the secondary fuel.

A broad spectrum of liquids are suitable as the liquid carrier medium for the secondary fuel. For example, not only can noncombustible liquids, in the simpliest case water, be utilized, but combustible liquids, which are generally of organic origin, can also be used. Although a primary example of such a combustible liquid is oil, other, lower boiling organic liquids, such as alcohols (methanol) can also be advantageously used as a carrier. A very suitable mixture comprises coal dust as the secondary fuel, and water as the carrier medium.

The ratio of secondary fuel to carrier medium can fluctuate over a broad range. The lower limit for the amount of carrier medium is defined by the ability of the suspension of fuel and carrier to atomize. The upper limit of the carrier medium is determined by economic feasibility and the required degree of $NO_x$ reduction. For practical purposes, the proportion of the carrier, relative to carrier and fuel, is 20 to 80% by weight.

Fuel and carrier are supplied to the combustion chamber in a finely divided or suspended form, generally via nozzles. No special nozzles are required to introduce or spray the fuel/carrier mixture into the combustion chamber. Rather, a sufficiently good distribution of the fuel and efficient atomization can be achieved with already known nozzle constructions.

All nozzle constructions known for the atomization of fluid or liquid, for example Y-atomizers, are suitable.

The secondary fuel can be atomized by various methods which are known per se. For this purpose, pressure is just as suitable as is the application of an independent medium, such as air, steam, or gas.

The inventive method makes it possible for the secondary fuel to penetrate to a sufficient depth into the combustion chamber, and to provide a thorough mixing; in addition, the distribution and regulation of the introduction of the fuel is simplified. The direction and quantity of introduction can be controlled independently of the respective boiler charge. Furthermore, individual nozzles can be cut in or out without having a reactive effect on the other nozzles.

DESCRIPTION OF PREFERRED EMBODIMENTS

Fuel and air for the primary combustion are supplied to the boiler 1 via the lines 2. To complete the combustion, combustion air is supplied after, i.e. downstream of, the primary combustion at 3. Between the fuel/air supply 2 for the primary combustion, and the secondary air supply 3, secondary fuel in a fluid or liquid carrier is sprayed in or introduced via the line 4 (or lines 4*a*–4*c*) into the combustion chamber of the boiler 1 via non-illustrated nozzles; A regulating device 5 (or 5*a*–5*c*) is provided for controlling the flow volume. The secondary fuel is supplied or returned in the line 6.

The fuel for the primary combustion can be solid, liquid, or gaseous, while the secondary fuel is always in the form of a suspension of either a solid or a liquid fuel in a liquid carrier medium, and to that extent is always liquid.

Figure 3:
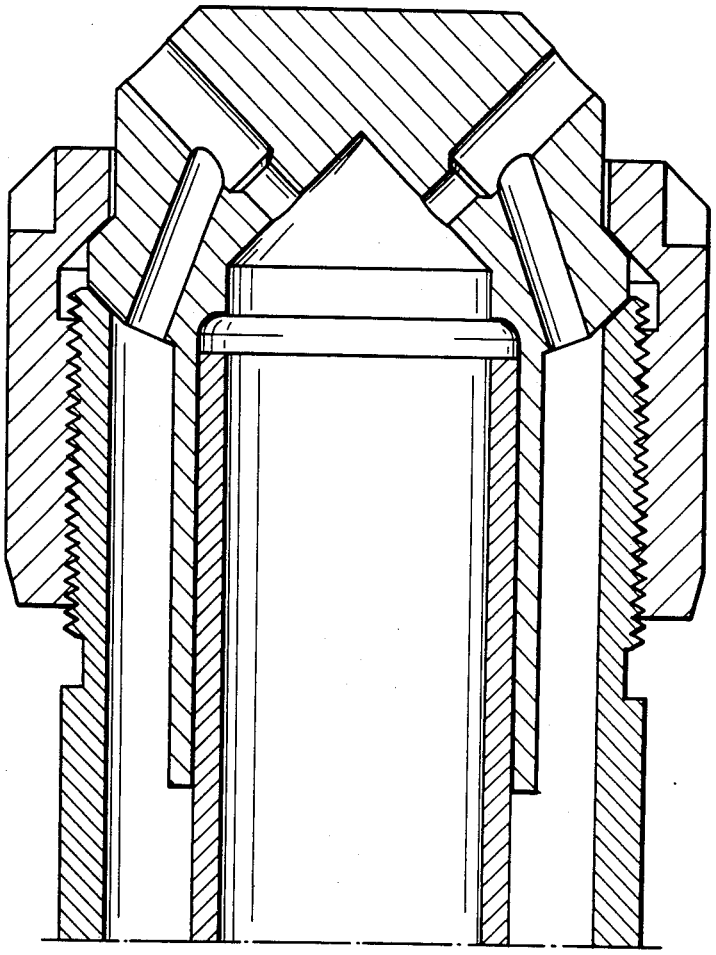
FIG. 3 is a view that shows one possible embodiment of a Y-atomizer for use as a nozzle for the introduction of the secondary fuel.

FIG. 3 represents a general design of a Y-atomizer which is suitable for atomizing the suspension. This atomizer can be utilized with various atomizing angles for the uniform distribution of the secondary fuel in the combustion chamber. The atomizing medium is conveyed through the central tube, and the secondary fuel/carrier mixture is conveyed through the outer tube.

The present invention is, of course, in no way restricted to the specific disclosure of the specification and drawings, but also encompasses any modifications within the scope of the appended claims.

What is claimed is:

1. In a method of reducing the $NO_x$ content in combustion gases by introducing a predetermined secondary fuel, via a carrier medium, into the combustion chamber at a location disposed between a lower location for the supply of fuel and air for the primary combustion and a higher location for the supply of secondary air for the complete combustion, the improvement therewith which comprises the steps of:

(a) using a finely particulated solid fuel as secondary fuel;

(b) introducing said secondary fuel into said combustion chamber in the form of a suspension in a non-combustible liquid carrier medium; and (c) atomizing said suspension via atomizing means selected from air, steam and gas.

2. A method according to claim 1, which includes the step of atomizing a suspension of secondary fuel in liquid carrier medium, with said suspension comprising 20–80% by weight carrier relative to the total weight of fuel and carrier.

* * * * *